US005153958A

United States Patent [19]

Okajima

[11] Patent Number: 5,153,958

[45] Date of Patent: Oct. 13, 1992

[54] VIBRATION-PROOF STRETCHER FOR EMERGENCY TREATMENT

[75] Inventor: Masakazu Okajima, Houya, Japan

[73] Assignee: Lundal Bed Industry Co., Ltd., Saitama, Japan

[21] Appl. No.: 795,558

[22] Filed: Nov. 21, 1991

[51] Int. Cl.[5] ..... A61G 1/00; A61G 1/02

[52] U.S. Cl. ..... 5/625; 5/89.1; 5/118; 5/186.1; 296/20

[58] Field of Search ..... 5/60, 89, 118, 186.1, 5/82, 600, 625; 296/20

[56] References Cited

U.S. PATENT DOCUMENTS

| | | | |
|---|---|---|---|
| 2,142,215 | 1/1939 | Schmidt | 296/20 |
| 2,360,453 | 10/1944 | Sullivan et al. | 296/20 X |
| 3,164,850 | 1/1965 | Grubb | 5/82.2 X |
| 3,648,305 | 3/1972 | Ersek | 5/82 R X |
| 3,699,593 | 10/1972 | Oetiker | 5/83 R X |
| 3,840,913 | 10/1974 | Feische | 5/186.1 X |
| 4,024,861 | 5/1977 | Vincent | 5/82.2 X |
| 4,953,886 | 9/1990 | Grant | 296/20 X |
| 4,979,243 | 11/1990 | Kelley | 5/118 |

FOREIGN PATENT DOCUMENTS 494012 10/1938 United Kingdom ..... 5/82 R

*Primary Examiner*—Michael F. Trettel

[57] ABSTRACT

A vibration-proof stretcher is usable for facilitating safe emergency treatment of a patient lying on the stretcher. The stretcher includes a chassis having wheels provided with tires; a bed frame provided on the chassis; a net frame provided inside the bed frame; net springs tightly anchored inside and to the net frame and constituting a net; additional springs tightly anchored to the bed frame and at least both side edge portions of the net frame so that a bed portion inside the bed frame is constituted by the net frame, the net springs and the additional springs being positioned to correspond to the position of the lower part of the body of a patient on the stretcher; a back plate having a head reception recess at a position corresponding to the position of the head of the patient on the stretcher, the back plate constituting a bed portion for the upper part of the body of the patient; a mat laid on the portion of the bed frame for the lower part of the body of the patient covering the net springs; and a fluid-filled mat having a fluid inlet port and a fluid outlet port laid over the portion of the bed frame for the upper part of the body of the patient so as to cover the back plate.

4 Claims, 4 Drawing Sheets

VIBRATION-PROOF STRETCHER FOR EMERGENCY TREATMENT

BACKGROUND OF THE INVENTION

The present invention relates to a vibration-proof stretcher for carrying an emergency patient to a nearby emergency hospital in an ambulance in which can be used to facilitate safe emergency treatment such as cardiopulmonary resuscitation and securing of the air passage of a patient lying on the stretcher.

There are different types of conventional stretchers used in an ambulance, such as stretchers a and b shown in FIGS. 6 and 7. Each of the stretchers a and b includes a chassis d having casters g provided with tires c, a bed frame e provided on the chassis divided into upper and lower portions for suporting the upper and lower parts of a patient lying on the stretcher, and a urethane mat f provided on lattices made of thin pipes of circular cross-section in the upper and lower portions of the bed frame (not shown in the drawings).

In recent years, the influence of vibration on a patient on such a stretcher has been regarded as a problem. Therefore, it has become important to address the question of how the patient on the stretcher can be carried more quietly. Maximum attention has consequently been paid to the conditions of the surface of the road and the traffic thereon in driving an ambulance to carry the patient on the stretcher. However, it has been reported that if the condition of the surface of the road is not good, the vibration of the ambulance is directly transmitted to the patient on the stretcher to make it likely that the patient undergoes pain or nausea to aggravate his condition, particularly when the patient is suffering from a serious disease, a heart problem, bone fracture or the like. One published paper reports that although external vibration on a human body is damped by the body if the frequency of the vibration is within a certain range, the amplitude of the vibration on the body is increased to resonance if the frequency of the vibration is equal to the natural frequency of the body. This paper reports that the resonance intensifies the jolt to the human body to further influence the body both psychologically and physiologically. The Japanese Association for Acute Medicine has announced a research result that reducing the influence of vibration of low frequency on the brain or other organs of a patient is an important factor in preventing the disease or injury of the patient from being aggravated.

It has been reported that even a healthy person feels very bad on such a conventional stretcher in a moving ambulance. The reason for the bad feeling is that the person is put on the stretcher with his head oriented in the same direction as the movement of the ambulance, which results in making him feel pressure in that direction at the time of stoppage or deceleration of the ambulance. Therefore, it is believed that the vibration on the patient on the stretcher and the movement of the affected part of his body not only give him mental restlessness or anguish, but also influence his convalescence from bone fracture, brain damage, cervical vertebra damage or the like.

Since the tires c of all four casters g of each of the conventional stretchers a and b are solidly or almost solidly made of rubber or plastic, vibration is scarcely absorbed by the tires. Since the bed lattices inside the bed frame e are made of thin pipes of circular cross-section, the vibration is not absorbed by the lattices at all.

Cardiopulmonary resuscitation, artificial respiration, heart massage and the like are emergency treatments. If such a treatment is not performed in time, the life of the patient cannot be expected to be saved, as shown by the Drinker survival curve $\alpha$ in FIG. 8. Therefore, such treatment is essential to enhance the rate of saving lives. If the patient lies directly on the urethane mat f of the stretcher, the upper part of his body sinks at the time of pressing thereon during heart massage so as to reduce the effect of the pressing. For that reason, a back plate h as shown in FIGS. 9 and 10 is interposed between the urethane mat f and the back of the patient P, as shown in FIG. 11, to perform the heart massage on him. However, since the patient and the back plate h are placed on the urethane mat f, the effect of the pressing during heart massage cannot always be made high enough to obtain a satisfactory result. Besides, if the stretcher, which is relatively heavy, is always provided with the back plate h, the stretcher becomes heavier. If the back plate h is always kept in the ambulance, since the stretcher is not always capable of carrying or accommodating the back plate, it is likely that the back plate must be fetched from the ambulance to the stretcher. Such fetching makes it impossible to perform an emergency treatment on the patient in time. Since securing the air passage of the patient requires the back plate h, it is necessary to take the trouble of fetching the back plate from the ambulance if the back plate is always kept in the ambulance.

SUMMARY OF THE INVENTION

The present invention was made in order to solve the above-mentioned problems of the conventional stretchers. Accordingly, it is an object of the invention to provide a vibration-proof stretcher which is effective and appropriate to solve such problems and which is usable to facilitate safe emergency treatment of a patient lying on the stretcher.

The vibration-proof stretcher is characterized by a chassis having wheels provided with tires; a bed frame provided on the chassis; a net frame provided inside the bed frame; net springs tightly anchored inside and to the net frame and constituting a net; additional springs tightly anchored to the bed frame and at least both side edge portions of the net frame so that a bed portion inside the bed frame is constituted by the net frame, the net springs and the additional springs being arranged in a position to correspond to the position of the lower part of the body of the patient; a back plate having a head reception recess arranged in a position corresponding to the position of the head of the patient and laid to constitute a bed portion for the upper part of the body of the patient; a mat laid on the portion of the bed frame for the lower part of the body of the patient and covering the net springs; and a fluid-filled mat having inlet and outlet ports for a fluid such as water or air and laid over the portion of the bed frame for the upper part of the body of the patient so as to cover the back plate. Accordingly, any vibration which occurs on the stretcher when a patient lying on the mat and the fluid-filled mat for the lower and upper parts of the body of the patient and having his head on a fluid-filled pillow is carried with the stretcher, or with the stretcher in an ambulance, is absorbed or reduced by the net springs, the additional springs, the mat and the fluid-filled mat so as to prevent the vibrational impact from being imparted to the affected part of the patient, to thus keep him at peace.

If the air passage of the patient is to be secured and/or heart massage is to be performed on the patient, the fluid-filled pillow is removed, and the fluid outlet port of the fluid-filled mat is opened to discharge the fluid from the mat by the weight of the upper part of the body of the patient in about four to five seconds to flatten the mat and sink the head of the patient into the head reception recess of the back plate to secure the air passage and/or facilitate heart massage on the patient on the back plate similarly to the heart massage shown in FIG. 11.

The amount of the fluid in the fluid-filled mat can be modulated depending on the physical condition or weight of the patient.

The tires of the wheels of the stretcher may be pneumatic tires of relatively larger diameter to further absorb or reduce the vibration on the patient when he is carried with the stretcher on a rugged road or with the stretcher in the ambulance on such a road. In that case, even if the patient is suffering from bone fracture, his affected part is kept at rest.

The back plate and the fluid-filled mat can be operated well enough to secure the air passage of the patient, since his body is in an ideal posture so that his affected part is moved less and his body is kept safer than with a conventional stretcher, particularly when he is suffering from skull fracture or cervical vertebra damage. As for cervical vertebra fracture, a thin plate or the like is interposed between his head and the back plate to keep his head from sinking into the head reception recess. If the patient is in the ideal posture on the stretcher, the contents of his stomach are unlikely to flow back into his air passage and he can be directly carried to an intensive care unit.

Desirable practical effects can thus be produced by the present invention.

DETAILED DESCRIPTION OF THE PREFERRED EMBODIMENTS

An embodiment of the present invention will now be described in detail with reference to the drawings.

Figure 1:
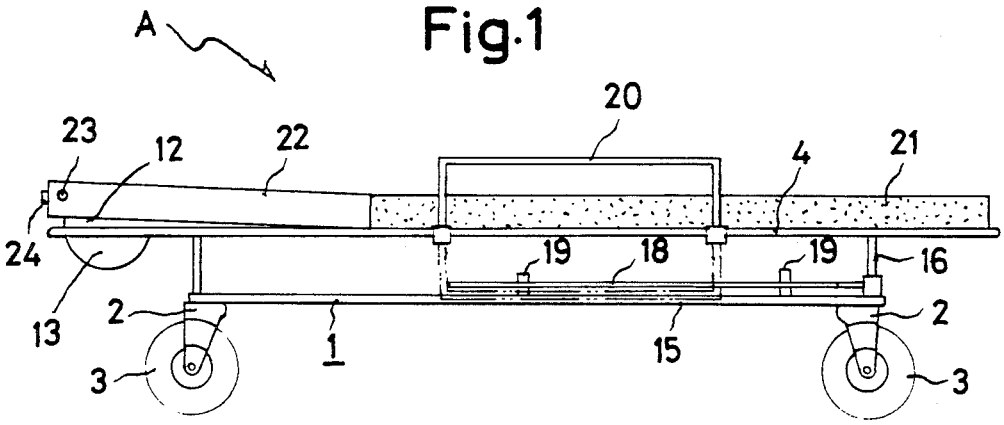
FIG. 1 is a side view of a vibration-proof stretcher constituting an embodiment of the present invention.
Figure 2:
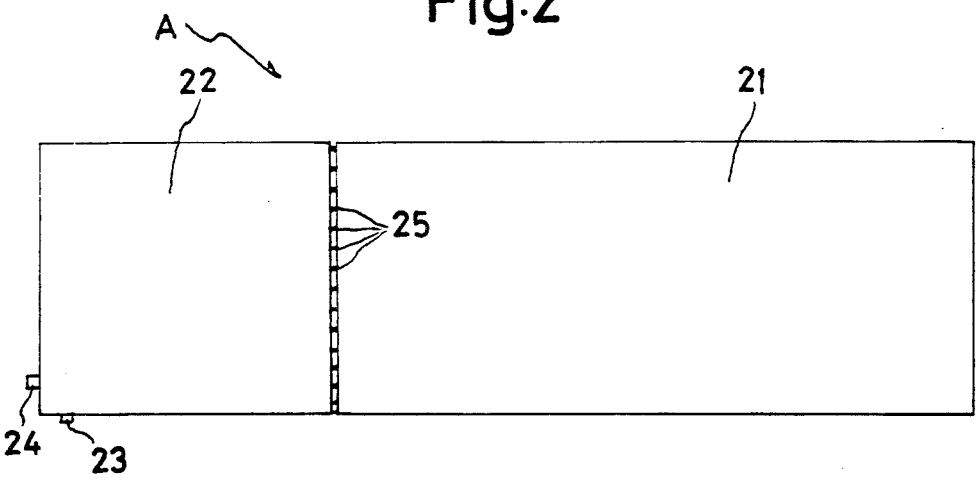
FIG. 2 is a plan view of the stretcher shown in FIG. 1.
Figure 3:
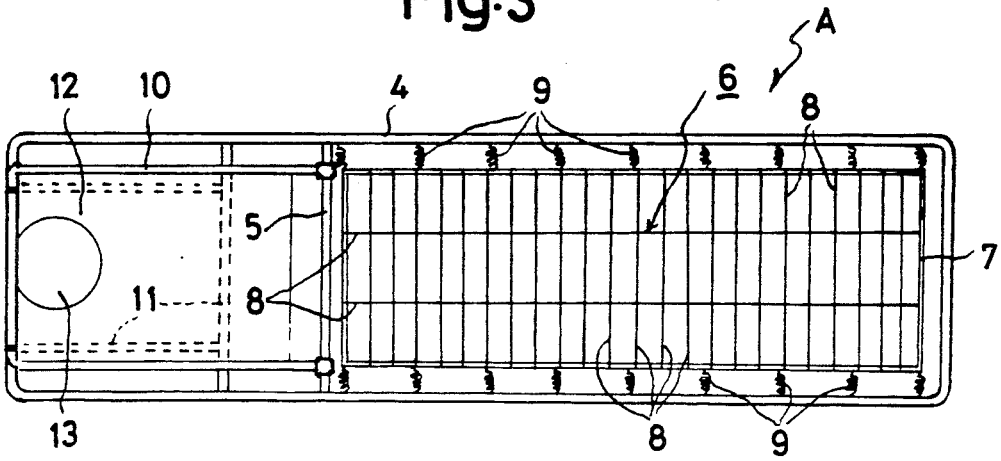
FIG. 3 is a plan view of the stretcher in a state in which a mat and a fluid-filled mat are removed.

FIGS. 1, 2 and 3 illustrate a vibration-proof stretcher A which is an embodiment of the invention and is usable to facilitate safe emergency treatment of a patient lying on the stretcher. The stretcher comprises a chassis 1, a bed frame 4, a dividing frame 5, a spring net 6, a net frame 7, helical springs 9, an adjustable frame 10, a lower frame 11, a back plate 12, an intravenous stand rod insertion member 14, an intravenous stand rod 18, side frames 20, a hard urethane mat 21, a fluid-filled mat 22, and a cover not shown in the drawings.

Figure 4:
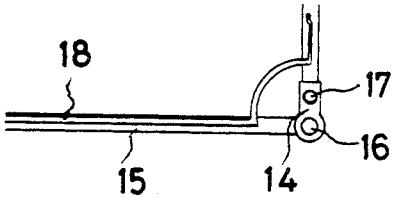
FIG. 4 is an enlarged view of a major part of the stretcher in a state in which an intravenous stand rod and an intravenous stand rod insertion member are put away and not in use.
Figure 5:
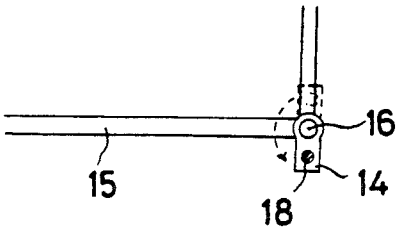
FIG. 5 is an enlarged view of the major part shown in FIG. 4 in a state in which the intravenous stand rod and rod insertion member are put in use.
Figure 6:
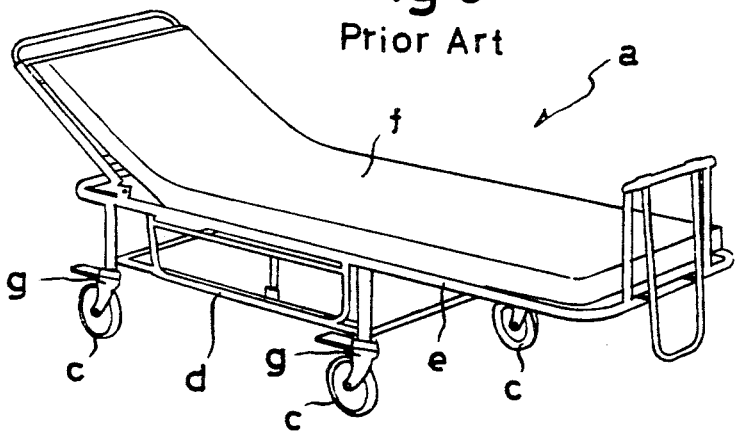
Fig.6 Prior Art
FIG. 6 is a perspective view of a conventional stretcher.
Figure 7:
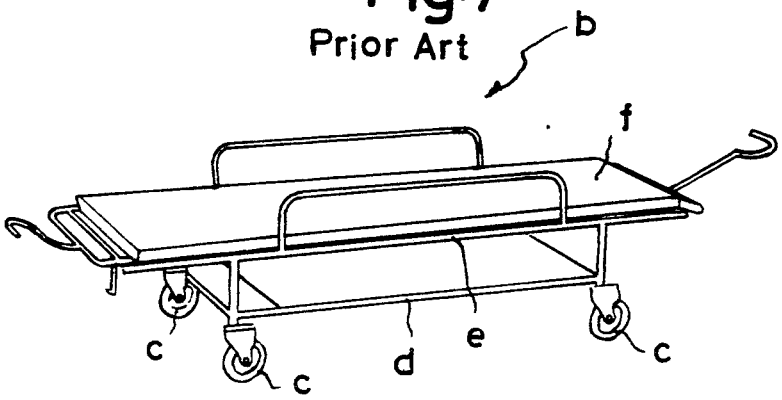
Fig.7 Prior Art
FIG. 7 is a perspective view of another conventional stretcher.
Figure 8:
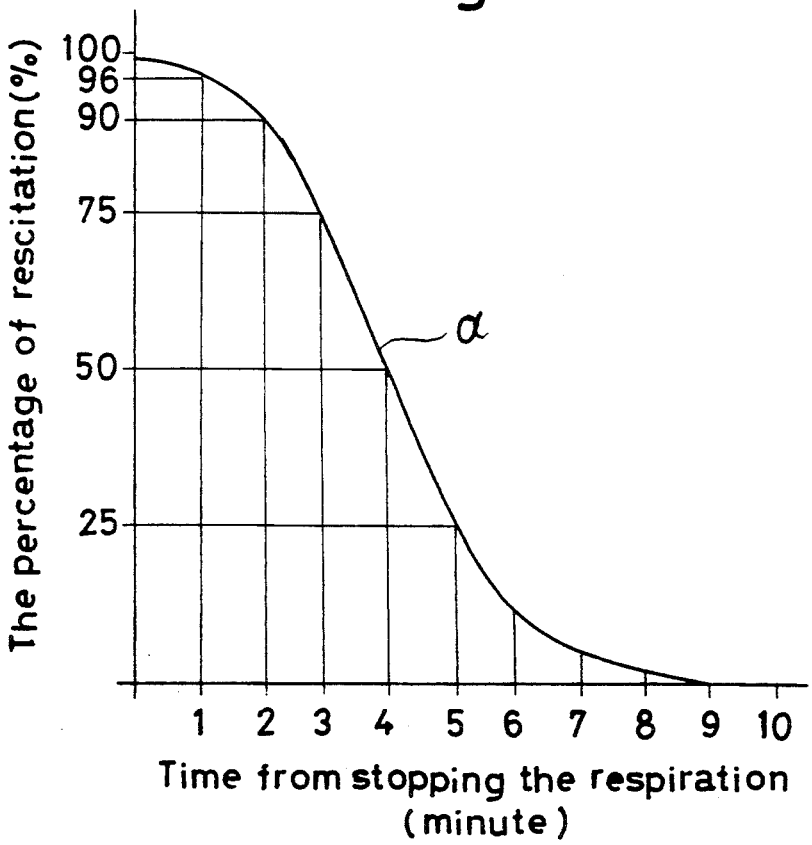
FIG. 8 is a graph showing the Drinker survival curve.
Figure 9:
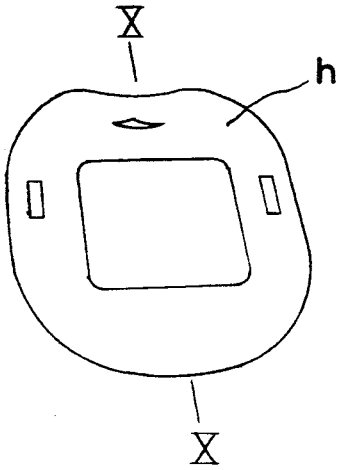
FIG. 9 is a perspective view of a back plate for heart massage.
Figure 10:
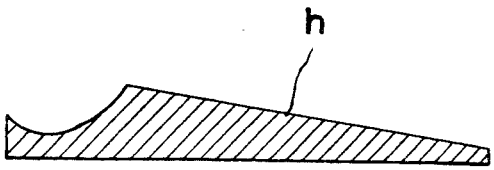
FIG. 10 is a sectional view of the back plate taken along lines x—x shown in FIG. 9.
Figure 11:
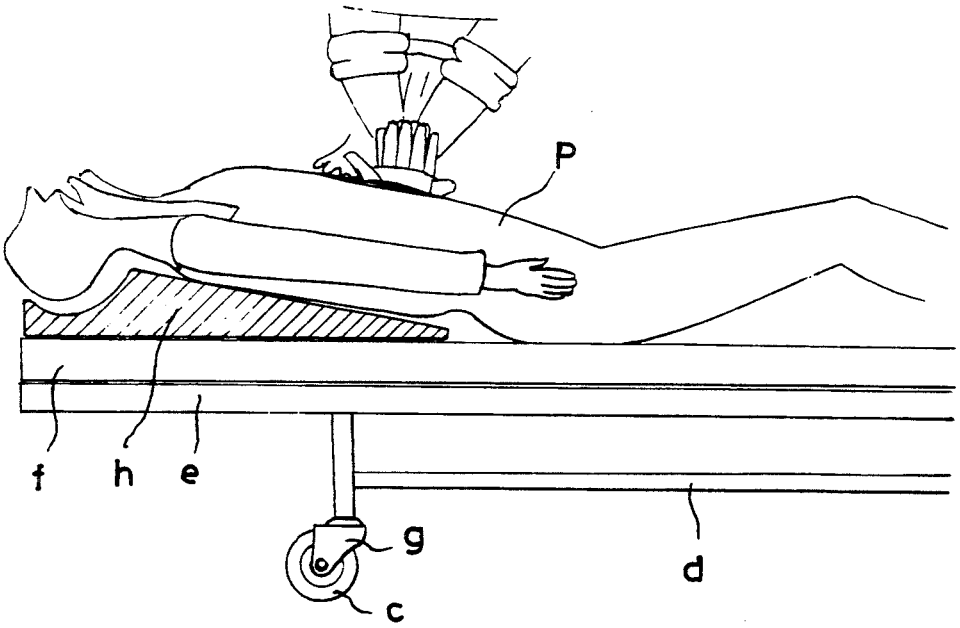
FIG. 11 is a view to illustrate heart massage on each of the conventional stretchers.

The chassis 1 has casters 2 provided at the four corners of the chassis having fluid-filled tires 3. The bed frame 4 is horizontally mounted on the chassis 1. The dividing frame 5 divides the opening inside the bed frame 4 into a portion which is nearly two-thirds of the opening and for the lower part of the body of a patient lying on the stretcher, and another portion which is nearly one-third of the opening for the upper part of the body of the patient lying on the stretcher. The spring net 6 is made of steel wires 8 tightly anchored as a lattice to the net frame 7 inside it. The helical springs 9 are tightly anchored to the bed frame 4 and both side edge portions of the net frame 7 between both the frames. The adjustable frame 10 is pivotally coupled to the dividing frame 5 so that the adjustable frame can be swung up and down for adjustment. The lower frame 11 supports the adjustable frame 10 thereunder. The back plate 12 is provided on the adjustable frame 10, has a head reception recess 13 for receiving the head of the patient, and has a slope extending so that the thickness of the back plate gradually increases from the inner end thereof toward the outer end thereof. The intravenous stand rod insertion member 14 has an intravenous stand rod insertion hole 17, and is fitted to a stanchion 16 of the frame 15 of the chassis 1 at one corner thereof so that the member can be swung up and down. The intravenous stand rod 18 is provided on instillator stand rod support members 19 on one side edge portion of the chassis frame 15, as shown in FIGS. 1 and 4. The side frames 20 are fitted to the bed frame 4 at both side edges thereof so that the side frames can be swung up and down. The hard urethane mat 21 has a thickness of 50 mm, and is disposed on the entire portion of the bed frame 4 for the lower part of the body of the patient so as to cover the spring net 6. The fluid-filled mat 22 is like a surfing air mat, and has a fluid inlet port 23 and a fluid outlet port 24. The fluid-filled mat 22 is provided on the entire portion of the bed frame 4 for the upper part of the body of the patient so as to cover the back plate 12. The urethane mat 21 and the fluid-filled mat 22 are sewn to each other at a sewing seam 25, and wrapped together in the cover.

If the patient needs an emergency transfusion, the intravenous stand rod 18 is detached from the intravenous stand rod support members 19, the instillator stand rod insertion member 14 is swung outward, the rod is inserted at the lower end thereof into the intravenous stand rod insertion hole 17 of the insertion member, and an intravenous is hung from the rod at the upper end thereof.

The present invention is not limited to the described embodiment, but may be embodied or practiced in various other ways without departing from the scope and spirit of the invention.

What is claimed is:

1. A vibration-proof stretcher for safe emergency treatment of a patient lying thereon, comprising a chassis having wheels provided with tires; a bed frame provided on said chassis; a net frame having opposite side edge portions and provided inside said bed frame; a net spring tightly anchored inside and to said net frame and constituting a net; additional springs tightly anchored to said bed frame and at least both of said opposite side edge portions of said net frame so that said net frame forms a first bed portion inside said bed frame to support the lower part of the body of a patient lying on said stretcher; a back plate having a head reception recess arranged at a position corresponding to the position of the head of said patient lying on said stretcher, said back plate being arranged within said bed frame to form a second bed portion inside said bed frame for supporting the upper part of the body of said patient lying on said stretcher; a mat removably positioned on the first bed portion of said bed frame for supporting the lower part of the body of said patient to cover said net spring; and a fluid-filled mat having a fluid inlet port and a fluid outlet port, said fluid-filled mat being removably positioned on said second bed portion of said bed frame for supporting the upper part of the body of said patient to cover said back plate.

2. A vibration-proof stretcher according to the claim 1, wherein the tires are pneumatic tires.

3. A vibration-proof stretcher according to any of claims 1 or 2, wherein said chassis includes a chassis frame, and further comprising an intravenous stand rod insertion member provided on said chassis frame, an intravenous stand rod and support means for detachably storing said intravenous stand rod on said chassis frame, whereby said intravenous stand rod can be inserted into said intravenous stand rod insertion member for use in intravenous transfusion and removed from said insertion member and stored on said chassis frame when said rod is not in use.

4. A vibration-proof stretcher according to claim 1, further comprising an adjustable frame supported on said bed frame, said back plate being supported on said adjustable frame.

* * * * *